US006190297B1

(12) United States Patent
Croft

(10) Patent No.: US 6,190,297 B1
(45) Date of Patent: Feb. 20, 2001

(54) APPARATUS FOR CUTTING AND CREASING SHEET MATERIAL

(75) Inventor: Russell F. Croft, Tolland, CT (US)

(73) Assignee: Gerber Scientific Products, Inc., Manchester, CT (US)

( * ) Notice: Under 35 U.S.C. 154(b), the term of this patent shall be extended for 0 days.

(21) Appl. No.: 09/206,029

(22) Filed: Dec. 4, 1998

(51) Int. Cl.[7] ..... B31B 1/25

(52) U.S. Cl. ..... 493/59; 493/60; 493/353; 493/370

(58) Field of Search ..... 83/168, 174, 941, 83/76.9; 493/59, 60, 61, 353, 354, 355, 366, 367, 370, 371; 400/616.3

(56) References Cited

U.S. PATENT DOCUMENTS

| | | | |
|---|---|---|---|
| 357,583 | | 2/1887 | Daniels . |
| 764,848 | | 7/1904 | Howard . |
| 1,142,654 | | 6/1915 | Wood . |
| 1,362,330 | | 12/1920 | Lange . |
| 1,585,012 | | 5/1926 | Biersdorf . |
| 1,633,655 | | 6/1927 | Walter . |
| 1,983,323 | | 12/1934 | Stokes . |
| 2,539,240 | | 1/1951 | Firestone . |
| 2,552,353 | | 5/1951 | Troth et al. . |
| 2,683,489 | | 7/1954 | Jackman . |
| 2,765,716 | | 10/1956 | Anderson . |
| 2,860,555 | | 11/1958 | Williamson . |
| 2,873,654 | | 2/1959 | MacCallum . |
| 3,008,365 | | 11/1961 | McNabb, Jr. . |
| 3,142,233 | | 7/1964 | Downie . |
| 3,477,322 | | 11/1969 | Gerber et al. . |
| 3,496,817 | | 2/1970 | Staats et al. . |
| 3,496,841 | | 2/1970 | Kirby et al. . |
| 3,735,660 | | 5/1973 | Pearl . |
| 3,735,674 | | 5/1973 | Haddock . |
| 3,744,384 | | 7/1973 | Jarrit et al. . |
| 3,752,042 | | 8/1973 | Castille . |
| 3,847,036 | | 11/1974 | Miller . |
| 3,937,109 | | 2/1976 | Korner et al. . |
| 3,942,411 | * | 3/1976 | Gerber ..... 83/941 |
| 3,981,213 | | 9/1976 | Lopman . |
| 4,249,432 | | 2/1981 | Graboyes et al. . |
| 4,417,883 | | 11/1983 | Granger et al. . |
| 4,467,525 | * | 8/1984 | Logan et al. . |
| 4,601,692 | * | 7/1986 | Rausing et al. ..... 493/355 |
| 4,822,325 | * | 4/1989 | Vossen ..... 493/61 |
| 5,241,733 | * | 9/1993 | Rosen ..... 83/941 |
| 5,509,885 | | 4/1996 | Brunlid . |
| 5,624,369 | * | 4/1997 | Bidlack et al. ..... 493/355 |
| 5,855,543 | | 1/1999 | Carbone . |
| 5,868,507 | * | 2/1999 | Thomas et al. ..... 400/616.3 |

OTHER PUBLICATIONS

U.S. application No. 08/826,367, Thomas et al., filed Apr. 20, 1997.

U.S. application No. 08/921,687, Croft et al., filed Sep. 2, 1997.

* cited by examiner

*Primary Examiner*—Eugene Kim
(74) *Attorney, Agent, or Firm*—McCormick, Paulding & Huber LLP

(57) ABSTRACT

An apparatus for making prototype packaging or boxes for various products includes a support surface for supporting a sheet material and a cutting tool for cutting contour lines of the box from the strip material. The support surface includes a recess to accommodate a bristle insert for providing a bristle surface for the cutting tool to engage during cutting operations. As the cutting tool penetrates the sheet material during the cutting operation and comes into contact with the bristle surface, the cutting tool does not become dulled and does not damage the bristle surface. The bristle surface also supports a creasing operation when crease lines are formed with a creasing tool within the sheet material. Alternatively, the apparatus of the present invention accommodates a grooved insert interchangeable with the bristle insert for creasing operations.

8 Claims, 3 Drawing Sheets

APPARATUS FOR CUTTING AND CREASING SHEET MATERIAL

BACKGROUND OF THE INVENTION

1. Technical Field

The present invention relates to an apparatus for making graphic products and, more particularly, to such apparatus for cutting and creasing heavy-weight sheet material.

2. Background Art

A plotting and cutting apparatus is used in the computer generated graphics, sign making and screen printing fields for a variety of purposes. For example, such apparatus is used for cutting graphic images or characters from sheets of vinyl or other polymeric materials, for drawing lines, characters or other graphic images on sheets of paper or polymeric materials, for pounding sheets to form perforated patterns, and for embossing sheets to form embossed patterns.

One type of such apparatus is described in a co-pending U.S. Pat. application Ser. No. 08/826,367, filed Apr. 9, 1997 and assigned to the Assignee of the present invention. The apparatus described in the above-mentioned co-pending patent application has a stationary platen forming a sheet support surface with a worksheet driven over it in a longitudinal direction by a plurality of sprockets. The apparatus also includes a tool supported by a tool carriage allowing lateral movement of the tool. The sheet support surface includes an elongated recess for receiving a low friction and relatively hard support surface. The support surface is in register with the tool such that if the tool is mistakenly driven through the sheet into engagement with the support surface, the tool will penetrate the support surface. For work operations on vinyl-type worksheets, the tool typically penetrates only the top layer and does not penetrate the bottom layer of the worksheet. The vinyl-type worksheets typically include a silicon coated bottom surface which is soft and slippery and does not dull the blade of the tool.

It is desirable to use such plotting and cutting apparatus to fabricate prototype boxes or packages for various products. Typically, the prototype boxes are manufactured from tagboard, cardboard or similar heavyweight sheet material. The prototype boxes are formed by first fabricating a flat blank by cutting around the contour of the box from the sheet material while either completely or substantially severing the flat blank box from the remainder of the sheet material. Typically, a number of tabs connecting the flat blank and the sheet material remain to prevent the blank from separating from the sheet material prior to completion of the operation. Once the contour of the box is cut, the flat blank is creased to form the lines of weakening for subsequent folding.

In order to generate a consistently high precision and quality final product, the cutting operation must yield crisp lines and sharp corners. Such high quality cutting requires the use of a very sharp cutting tool. When the plotting and cutting apparatus described above is used, if the cutting blade cuts through the sheet material and even slightly engages and penetrates the hard sheet support surface, the blade will become dull very quickly. The dull blade losses the ability to produce high quality cuts and to maintain high precision when cutting around the corners of the flat blank. Additionally, the support surface becomes cut and damaged. The cut support surface, which is no longer smooth and includes protruding upwards surfaces, increases friction between the surface and sheet material, thereby inhibiting the motion of the material and the accuracy of the cut.

To further complicate the problem of making high precision, quality prototype boxes, for achieving a good crease in the flat blanks, the sheet material support surface must allow displacement of the sheet material underlying the crease.

Therefore, efficient production of high quality and precision prototype boxes requires two different types of specialized or special purpose support surfaces. One such surface to allow material displacement during creasing of the flat blank and a second support surface allowing complete severing of the flat blank from the sheet material without damaging the support surface or dulling the cutting blade.

SUMMARY OF THE INVENTION

It is an object of the present invention to provide an apparatus for cutting and creasing heavy-weight sheet material.

It is another object of the present invention to ensure high precision of a cutting operation and high quality of a creasing operation during fabrication of prototype boxes.

It is a further object of the present invention to minimize damage to a sheet support surface and to a cutting blade during cutting and creasing operations of heavy-weight sheet material.

According to the present invention, an apparatus for fabricating prototype packaging or boxes from heavy-weight sheet material includes a sheet material support having a recess to accommodate a bristle insert and a tool for penetrating the sheet material and engaging a bristle surface of the bristle insert. The bristle surface does not dull the tool and does not sustain damage during cutting operations. Additionally, the bristle surface provides support to the strip material while allowing the strip material to deform at a creasing line during a creasing operation.

One feature of the present invention is that the bristle insert is interchangeable with a grooved insert during certain creasing operations. The grooved insert includes a groove to allow the strip material to deform in response to pressure exerted by the creasing tool.

One advantage of the present invention is that it minimizes dulling of the tip of the blade during cutting operations, since the tip of the blade does not cut through the bristles of the brush. Another advantage of the present invention is that damage to the sheet support surface is minimized. The bristles of the brush insert do not sustain damage. A further advantage of the present invention is that the bristle surface provides an effective surface for creasing operations as well. An additional advantage of the present invention is that the grooved insert is interchangeable with the bristle insert and yields high quality crease lines.

The foregoing and other advantages of the present invention become more apparent in light of the following detailed description of the exemplary embodiments thereof, as illustrated in the accompanying drawings.

DETAILED DESCRIPTION OF THE PRESENT INVENTION

Figure 1:
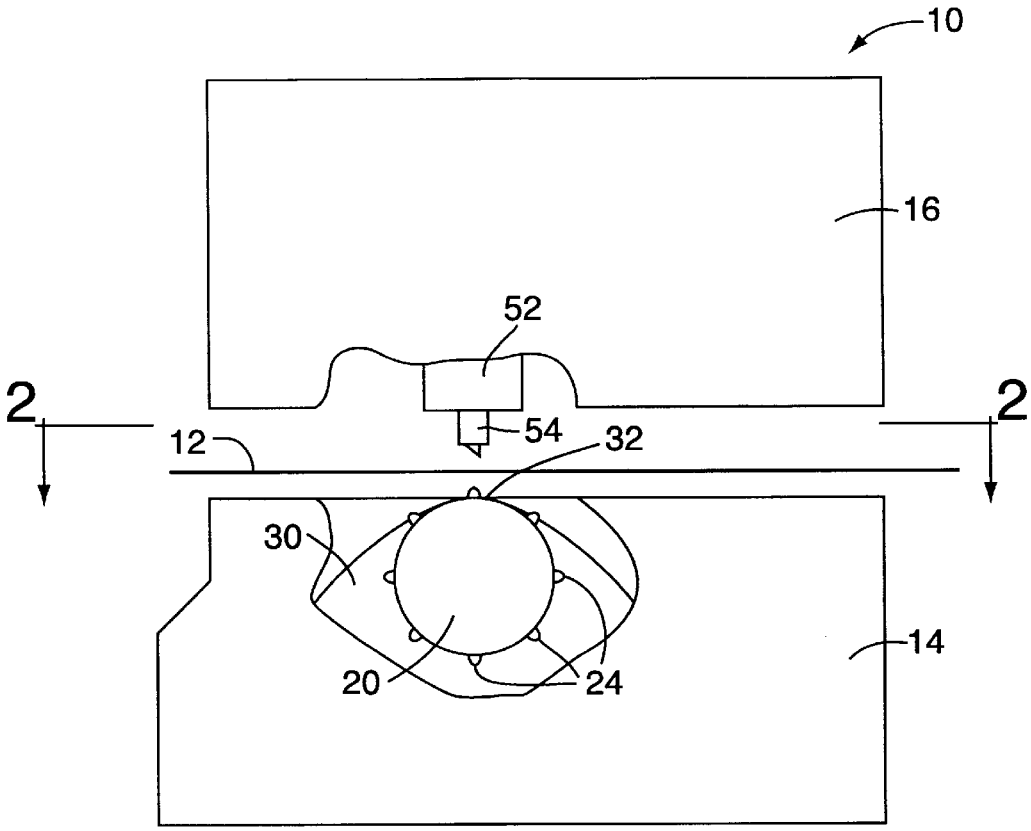
FIG. 1 is a schematic, exploded, partially broken away side view of an apparatus for feeding sheet material therethrough.
Figure 2:
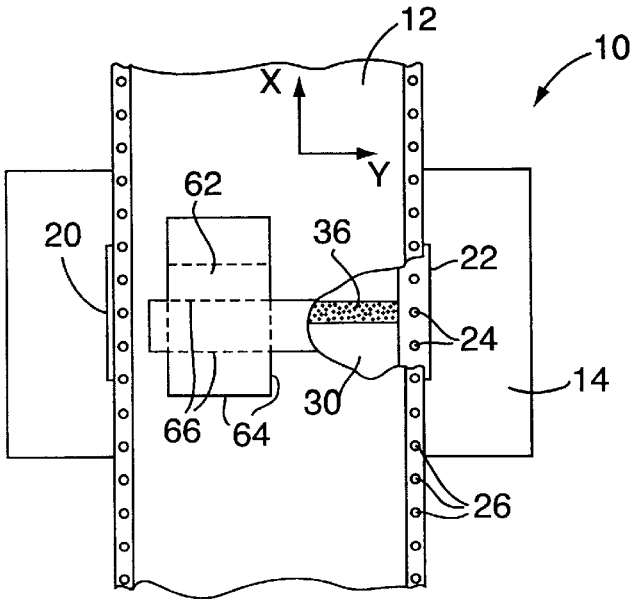
FIG. 2 is a schematic, partially broken away, top view of the sheet material placed onto a bottom portion of the apparatus of FIG. 1 taken along the line 2—2.

Referring to FIG. 1, an apparatus 10 for performing work operations on sheet material 12 includes a bottom portion 14 and a top portion 16. The bottom portion 14 includes a pair of sprockets 20, 22 for feeding the strip material 12 in a longitudinal or X-axis direction, as best seen in FIG. 2. Each sprocket 20, 22 includes a plurality of sprocket pins 24 for engaging feed holes 26 formed in the strip material 12. The bottom portion 14 also includes a stationary support or platen 30 disposed between the sprockets 20, 22. The platen 30 has a platen support surface 32 for supporting the sheet material 12. The platen 30 also includes a recess 34 for receiving a bristle insert 36, as shown in FIG. 3.

Figure 3:
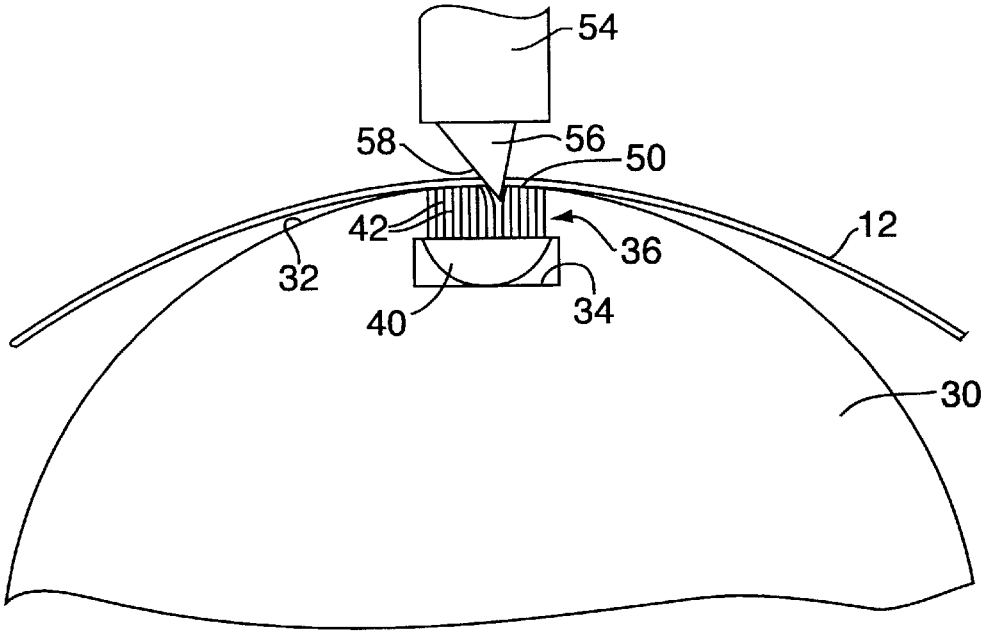
FIG. 3 is an enlarged, partial side view of a sheet material support of the apparatus of FIG. 2 with a bristle insert placed therein to allow a cutting tool to cut sheet material without dulling the blade and without damaging the sheet material support surface.
Figure 4:
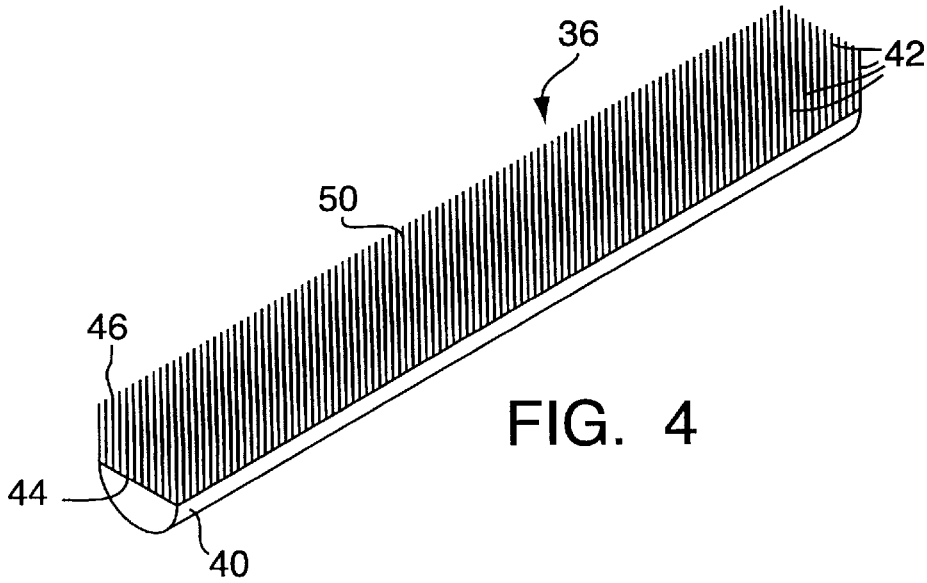
FIG. 4 is a perspective view of the bristle insert of FIG. 3.

Referring to FIG. 4, the bristle insert 36 includes a base 40 adapted to fit into the recess 34 and a plurality of bristles 42 protruding therefrom. Each bristle 42 includes a bristle bottom portion 44 and bristle tip portion 46. The bristle tip portions 46 form a bristle surface 50 which is substantially flush with the platen support surface 32, as best seen in FIG. 3. The recess 34 of the platen 30 is shaped to retain the bristle insert 36 therein, as best seen in FIG. 3.

The top portion 16 of the apparatus 10 includes a tool carriage 52 extending in a lateral or Y-axis direction and movably supporting a tool 54, as best seen in FIGS. 1 and 3. The tool 54 is movable within the tool carriage 52 in the lateral or Y-axis direction. The tool 54 includes a swivel blade 56 having a blade tip 58. The tool 54 is also movable downward by means of a controlled electro-magnetic coil (not shown) to draw the blade tip 58 into engagement with the strip material 12, as shown in FIG. 3.

In operation, the sheet material 12, typically a heavy-weight material such as tagboard or cardboard, is fed into the apparatus 10 in the longitudinal direction, as shown in FIGS. 1 and 2. The sprocket pins 24 engage the feed holes 26 of the strip material 12, thereby advancing the strip material 12 in the longitudinal direction. The strip material 12 is supported by the platen 30, coming into contact with the support surface 32 of the platen 30 and the bristle surface 50 of the bristle insert 36. Once the strip material 12 is properly positioned within the apparatus 10, the tool 54 moves downwardly to engage the tip 58 of the blade 56 with strip material 12. The tool 54 subsequently is moved in the lateral direction within the tool carriage 52 while the strip material 12 is driven in the longitudinal direction, according to a program resident in an apparatus controller (not shown) to complete the necessary cutting operation. The blade 56 is commanded to cut a contour of a prototype box 62, referred to as a blank, by penetrating through the sheet material 12 and making contour lines 64, as shown in FIG. 2. As the blade 56 penetrates the strip material 12 to either completely or partially sever the flat blank 62 from the remaining strip material 12, the blade tip 58 penetrates the strip material 12 and comes into contact with the bristle surface 50. The tip 58 of the blade 56 pushes the tip portions 46 of the bristles 42 apart as the tip 58 comes in contact with the bristle surface 50. Thus, as the strip material 12 is advanced in the longitudinal direction and the blade 56 is slewed in the lateral direction along the tool carriage 52 penetrating the strip material 12, the bristle tips 46 are pushed away thereby preventing the blade tip 58 from coming into contact with a hard surface, while providing a relatively firm support surface for the strip material 12, as best seen in FIG. 3.

Figure 5:
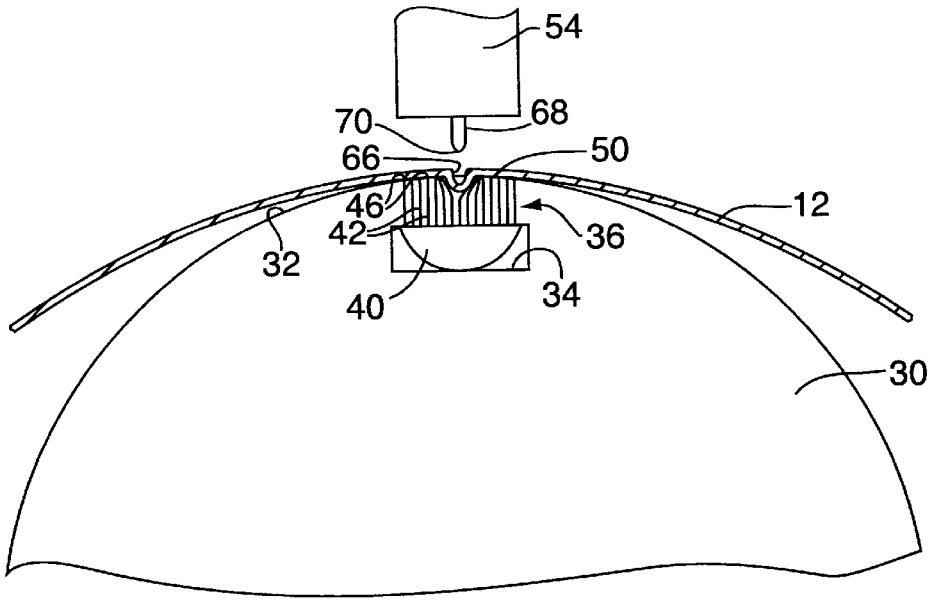
FIG. 5 is an enlarged, partial side view of the sheet material support of the apparatus of FIG. 2 with the bristle insert placed therein and a creasing tool making a crease line in the sheet material.

Additionally, the bristle surface 50 can be used for forming crease lines 66, as shown in FIG. 2. Referring to FIG. 5, the blade 56 is replaced with a creasing tool 68 which can be either a creasing wheel or a blunt point tool. The creasing tool 68 includes a creasing surface 70 that comes into contact with the strip material 12 to be creased. The creasing surface 70 of the creasing tool 68 pushes the strip material 12 at the crease line 66 downward into the bristle surface 50. As the creasing tool 68 exerts pressure onto the strip material 12, the tip portions 46 of the bristles 42 move aside allowing the strip material 12 to deform, thereby forming crease lines 66. Although the bristle surface 50 allows the strip material 12 to deform at the crease lines 66, it still provides a relatively firm surface for the portions of the strip material 12 that do not come in contact with the creasing tool 68.

Figure 6:
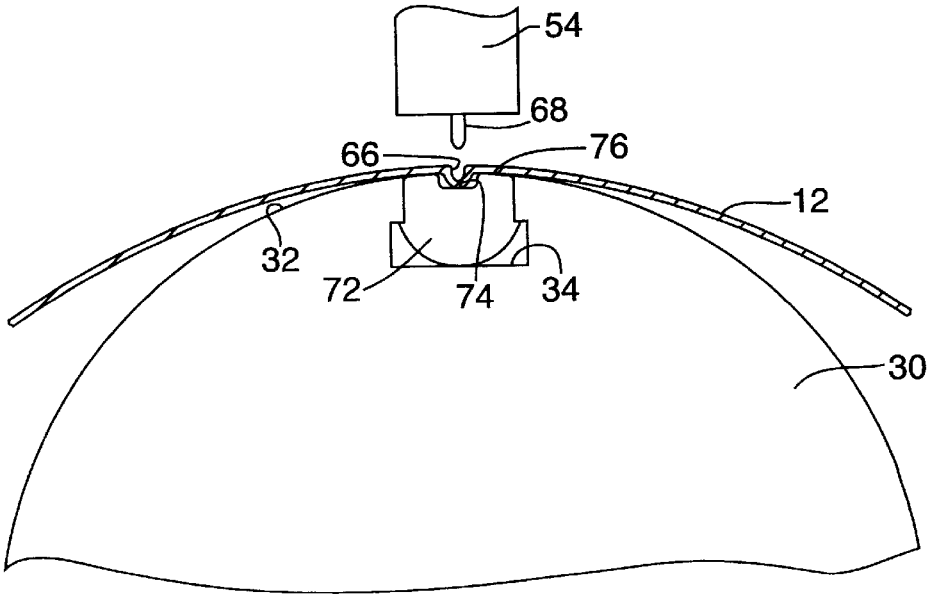
FIG. 6 is an enlarged, partial side view of the sheet material support of the apparatus of FIG. 2 with a grooved insert placed therein and the creasing tool making a crease line in the sheet material.

Referring to FIG. 6, alternatively, the bristle insert 36 is replaced with a grooved insert 72 for the creasing operation. The grooved insert 72 includes a groove 74 for allowing the strip material to deform and grooved insert support surface 76 to provide support for the portions of the strip material 12 that are not being deformed. For certain creasing operations that require a crisper or deeper crease line 66, the recess 34 of the apparatus of the present invention accommodates the grooved insert 72. As the creasing tool 68 exerts pressure onto the strip material 12, the strip material 12 deforms into the groove 74 to form the crease lines 66.

One advantage of the present invention is that the bristle surface 50 minimizes dulling of the tip of the blade during a cutting operation since the tip of the blade 56 does not engage a hard surface, but rather comes into contact with the bristles 42 of the bristle insert 36. Another advantage of the present invention is that damage to the sheet support surface 32 is minimized. The bristles 42 of the bristle insert 36 do not sustain damage. A further advantage of the present invention is that the bristle surface 50 provides an effective surface for creasing operations as well. An additional advantage of the present invention is that the bristle insert 36 is interchangeable with the grooved insert 72 to allow certain creasing operations to be performed over the grooved 74.

While the present invention has been illustrated and described with respect to a particular embodiment thereof, it should be appreciated by those of ordinary skill in the art, that various modifications to this invention may be made without departing from the spirit and scope of the present invention. For example, although the apparatus of the present invention is described as having sprockets driving the sheet material, the sheet material can be friction fed.

I claim:

1. An apparatus for cutting and creasing sheet material, said sheet material being driven in a longitudinal direction and having longitudinal edges, said apparatus comprising:

a sheet support for supporting said sheet material driven in said longitudinal direction relative to said sheet support, said sheet support having a sheet support surface and a recess formed therein and extending in a lateral direction transverse to said longitudinal direction;

a tool carriage disposed aboved said sheet support;

a tool supported by said tool carriage, said tool being movable in said lateral direction over said sheet material and said recess in said sheet support; and a bristle insert fitting into said recess, said bristle insert having a base with a plurality of bristles protruding from said base, each of said plurality of bristles having a bottom bristle portion and a tip bristle portion, said tip bristle portions forming a bristle surface, said bristle surface being substantially flush with said sheet support surface for supporting said sheet material during cutting operations with a cutting tool and separate creasing operations with a creasing tool.

2. The apparatus according to claim 1, wherein said tool is a cutting blade.

3. The apparatus according to claim 1, wherein said tool is a creasing tool.

4. The apparatus according to claim 1 further comprising:

a pair of sprockets disposed substantially adjacent to said sheet support surface and engaging said longitudinal edges of said sheet material for driving said sheet material in said longitudinal direction.

5. An apparatus for cutting and creasing sheet material, said sheet material being driven in a longitudinal direction and having longitudinal edges, said apparatus comprising:

a sheet support for supporting said sheet material driven in said longitudinal direction relative to said sheet support, said sheet support having a sheet support surface and a recess formed therein and extending in a lateral direction transverse to said longitudinal direction;

a tool carriage disposed above said sheet support;

a tool supported by said tool carriage, said tool being movable in said lateral direction over said sheet material and said recess in said sheet support;

a bristle insert fitting into said recess, said bristle insert having a base with a plurality of bristles protruding from said base, each of said plurality of bristles having a bottom bristle portion and a tip bristle portion, said tip bristle portions forming a bristle surface, said bristle surface being substantially flush with said sheet support surface; and a grooved insert fitting into said recess of said sheet support, said grooved insert having a groove formed therein, said grooved insert being interchangeable with said bristle insert.

6. An apparatus for cutting and creasing sheet material, said sheet material being driven in a longitudinal direction and having longitudinal edges, said apparatus comprising:

a sheet support for supporting said sheet material, said sheet support having a sheet support surface and a recess formed therein;

a bristle insert fitting into said recess, said bristle insert having a base with a plurality of bristles protruding from said base, each of said plurality of bristles having a bottom bristle portion and a tip bristle portion, said tip bristle portions forming a bristle surface, said bristle surface being substantially flush with said sheet support surface;

a tool carriage disposed above said sheet support; and a tool supported by said tool carriage, said tool being movable in a lateral direction over said sheet material, said tool penetrating said sheet material and engaging said bristle surface without dulling said tool and without damaging said bristle surface during cutting operations, said bristle surface supporting said sheet material during cutting operation and during separate creasing operations with a creasing tool.

7. A method for fabricating a prototype box from sheet material, said method comprising the steps of:

placing said sheet material in an apparatus for cutting and creasing said sheet material;

cutting around a contour of said prototype box with a cutting tool, said cutting tool having a blade penetrating said sheet material and coming into contact with a bristle surface of a bristle insert disposed beneath said sheet material; and creasing said prototype box with a creasing tool during a separate creasing operation to form lines of weakening for subsequent folding with said bristle surface supporting said sheet material being creased.

8. A method for fabricating a prototype box from sheet material, said method comprising the steps of:

placing said sheet material in an apparatus for cutting and creasing said sheet material;

cutting around a contour of said prototype box with a cutting tool, said cutting tool having a blade penetrating said sheet material and coming into contact with a bristle surface of a bristle insert disposed beneath said sheet material;

replacing said bristle surface of said bristle insert with a grooved surface of a grooved insert; and creasing said prototype box with a creasing tool to form lines of weakening for subsequent folding.

* * * * *